US007203437B2

(12) United States Patent
Kikuchi

(10) Patent No.: US 7,203,437 B2
(45) Date of Patent: Apr. 10, 2007

(54) FIXING APPARATUS AND IMAGE FORMING APPARATUS

(75) Inventor: Kazuhiko Kikuchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 264 days.

(21) Appl. No.: 11/036,003

(22) Filed: Jan. 18, 2005

(65) Prior Publication Data

US 2006/0159478 A1 Jul. 20, 2006

(51) Int. Cl.
*G03G 15/20* (2006.01)
*H05B 1/00* (2006.01)

(52) U.S. Cl. ..... 399/69; 399/330

(58) Field of Classification Search ..... 399/69, 399/67, 328, 330, 335; 219/216
See application file for complete search history.

(56) References Cited

U.S. PATENT DOCUMENTS 5,512,993 A * 4/1996 Endo et al. ..... 399/335
5,671,462 A * 9/1997 Toyohara et al. ..... 399/33
5,758,228 A * 5/1998 Hirose et al. ..... 399/70
6,724,999 B2 4/2004 Kikuchi et al.
7,082,272 B2 * 7/2006 Takano ..... 399/69
2006/0120745 A1 * 6/2006 Kinouchi et al. ..... 399/69
2006/0165428 A1 * 7/2006 Hasegawa ..... 399/69

FOREIGN PATENT DOCUMENTS

JP 2001-312178 A 11/2001

* cited by examiner

*Primary Examiner*—Anjan Deb
(74) *Attorney, Agent, or Firm*—Foley & Lardner LLP

(57) ABSTRACT

If the temperature T1 of the middle part of a heat roller 2 is higher than the temperature T2 of the end parts of the heat roller 2 [T1≧(T2−X)], the operating time B of side coils 5 and 6 is set longer than the operating time A of a center coil. If the temperature T1 of the middle part of a heat roller 2 is lower than the temperature T2 of the end parts of the heat roller 2 [T1<(T2−X)], the operating time A of the center coil is set longer than the operating time B of side coils 5 and 6.

18 Claims, 9 Drawing Sheets

FIG. 6

| | T1 | |
|---|---|---|
| | Less than 16℃ | 16℃ or more |
| Warming-up | 1 | 2 |
| Printing | 3 | 3 |

| Command value | 0 | 1 | 2 | 3 | 4 | 5 | 6 |
|---|---|---|---|---|---|---|---|
| Correction value X | +15℃ | +10℃ | +5℃ | 0 | −5℃ | −10℃ | −15℃ |

FIG. 7

| Set output [W] | | T1≧(T2-X) | | T1<(T2-X) | |
|---|---|---|---|---|---|
| Center coil P1 | Side coils P2 | Operating time A of the center coil | Operating time B of the side coils | Operating time A of the center coil | Operating time B of the side coils |
| 900 | 900 | 0.1sec | 0.2sec | 0.2sec | 0.1sec |

FIG. 8

| Paper sheet | | Set output [W] | | T1≧(T2-X) | | T1<(T2-X) | |
|---|---|---|---|---|---|---|---|
| Size | Thinkness | Center coil P1 | Side coils P2 | Operating time A of the center ciol | Operating time B of the side ciols | Operating time A of the center ciol | Operating time B of the side ciols |
| A4/B4 | Reqular | 900 | 900 | 0.1sec | 0.2sec | 0.2sec | 0.1sec |
| | Thick | 900 | 900 | 0.1sec | 0.2sec | 0.2sec | 0.1sec |
| B4/B5 | Reqular | 900 | 800 | 0.1sec | 0.2sec | 0.35sec | 0.2sec |
| | Thick | 1000 | 800 | 0.1sec | 0.2sec | 0.3sec | 0.2sec |
| A4-R | Reqular | 900 | 800 | 0.1sec | 0.2sec | 0.35sec | 0.2sec |
| | Thick | 1000 | 800 | 0.1sec | 0.2sec | 0.3sec | 0.2sec |
| B5-R | Reqular | 900 | 700 | 0.1sec | 0.2sec | 0.45sec | 0.3sec |
| | Thick | 1000 | 700 | 0.1sec | 0.2sec | 0.4sec | 0.3sec |
| A5-R | Reqular | 900 | 700 | 0.1sec | 0.2sec | 0.45sec | 0.3sec |
| | Thick | 1000 | 700 | 0.1sec | 0.2sec | 0.4sec | 0.3sec |
| Postcard | ——— | 900 | 700 | 0.1sec | 0.2sec | 0.45sec | 0.3sec |

FIG. 9

FIXING APPARATUS AND IMAGE FORMING APPARATUS

BACKGROUND OF THE INVENTION

Image forming apparatuses read images from documents, form developer images corresponding to the images read, on paper sheets, and fix the developer images on the paper sheets by using a fixing apparatus.

In the fixing apparatus, a paper sheet is held between the heat roller and the press roller, and heat and pressure are applied to the paper sheet. The developer image on the paper sheet is thereby fixed.

A center coil and side coils are provided within or outside the heat roller. These coils generate high-frequency magnetic fields when a high-frequency current is supplied to them. From the high-frequency magnetic fields there are generated eddy currents. The eddy currents turn into Joule heat. The Joule heat heats the heat roller. A fixing apparatus of induction heating type is disclosed in, for example, Jpn. Pat. Appln. KOKAI Publication No. 2001-312178.

The center coil performs induction heating at that part of the heat roller which is almost middle in the axial direction of the heat roller (i.e., the direction at right angles to the direction in which the heat roller rotates). The side coils perform induction heating at one end of the heat roller and the other end thereof, respectively. The center coil and the side coils are alternately driven, each for a prescribed time.

As a paper sheet passes, while nipped between the heat roller and the press roller, however, the heat roller is more heated at the end parts than at the middle part. Thus, the end parts of the press roller rise to a higher temperature than the middle part of the press roller.

The press roller is made of rubber. When its end parts rise to a higher temperature than its middle part, the press roller becomes soft, more quickly at the end parts than at the middle part.

Once the hardness of the end parts of the press roller has more decreased than the middle part of the press roller, the end parts of the press roller cannot transport paper sheets so efficiently as the middle part. Consequently, a paper sheet will be creased.

Further, when the end parts of the press roller rise to a higher temperature than the middle part of the press roller, much water evaporates from the lateral edges of the paper sheet. The paper sheet is inevitably curled.

BRIEF SUMMARY OF THE INVENTION

The object of an embodiment of this invention is to provide a fixing apparatus and an image forming apparatus, which can maintain the end parts and middle part of a heat roller at the same temperature, thereby to prevent paper sheets from being creased and curled.

A fixing apparatus according to this invention comprises:

a heating member which rotates;

a pressing member which rotate together with the heating member, while remaining in contact with the heating member, and which exerts a pressure to an object nipped between the heating member and the pressing member;

a first coil which performs induction heating at a first region that is a part of the heating member and extends in a direction that intersects at right angles with a direction in which the heating member rotates;

a second coil which performs induction heating at a second region that is a different part of the heating member and extends in the direction that intersects at right angles with the direction in which the heating member rotates;

a first temperature sensor which detects a temperature T1 of the first region of the heating member, which extends in the direction that intersects at right angles with the direction in which the heating member rotates;

a second temperature sensor which detects a temperature T2 of the second region of the heating member, which extends in the direction that intersects at right angles with the direction in which the heating member rotates;

first control means which causes the first coil and the second coil to operate alternately; and second control means which controls a ratio of an operating time of the first coil to an operating time of the second coil, in accordance with a ratio of the temperature T1 detected by the first temperature sensor to the temperature T2 detected by the second temperature sensor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

FIG. 6 is a diagram showing the conditions for setting a correction value in an embodiment;

FIG. 7 is a diagram showing various command values used in an embodiment and the correction values corresponding to the command values;

FIG. 8 is diagram showing operating conditions for the warming-up process in an embodiment;

FIG. 9 is a diagram showing conditions for printing in an embodiment;

DETAILED DESCRIPTION OF THE INVENTION

[1] An embodiment of this invention will be described, with reference to the accompanying drawings.

An image forming apparatus according to the invention comprises a scanning unit (i.e., scanning unit 33, described later), a process unit (i.e., process unit 45, described later), and a fixing apparatus (i.e., fixing apparatus 1, described later). The scanning unit optically reads images from documents. The process unit forms develop images corresponding to the images ready by the scanning unit, on paper sheets to which the images will be fixed. The fixing apparatus heats developer images formed on paper sheets, thus fixing them to the paper sheets. The structure of the image forming apparatus is disclosed in application Ser. No. 10/602,920 already filed, and will not be described.

Figure 1:
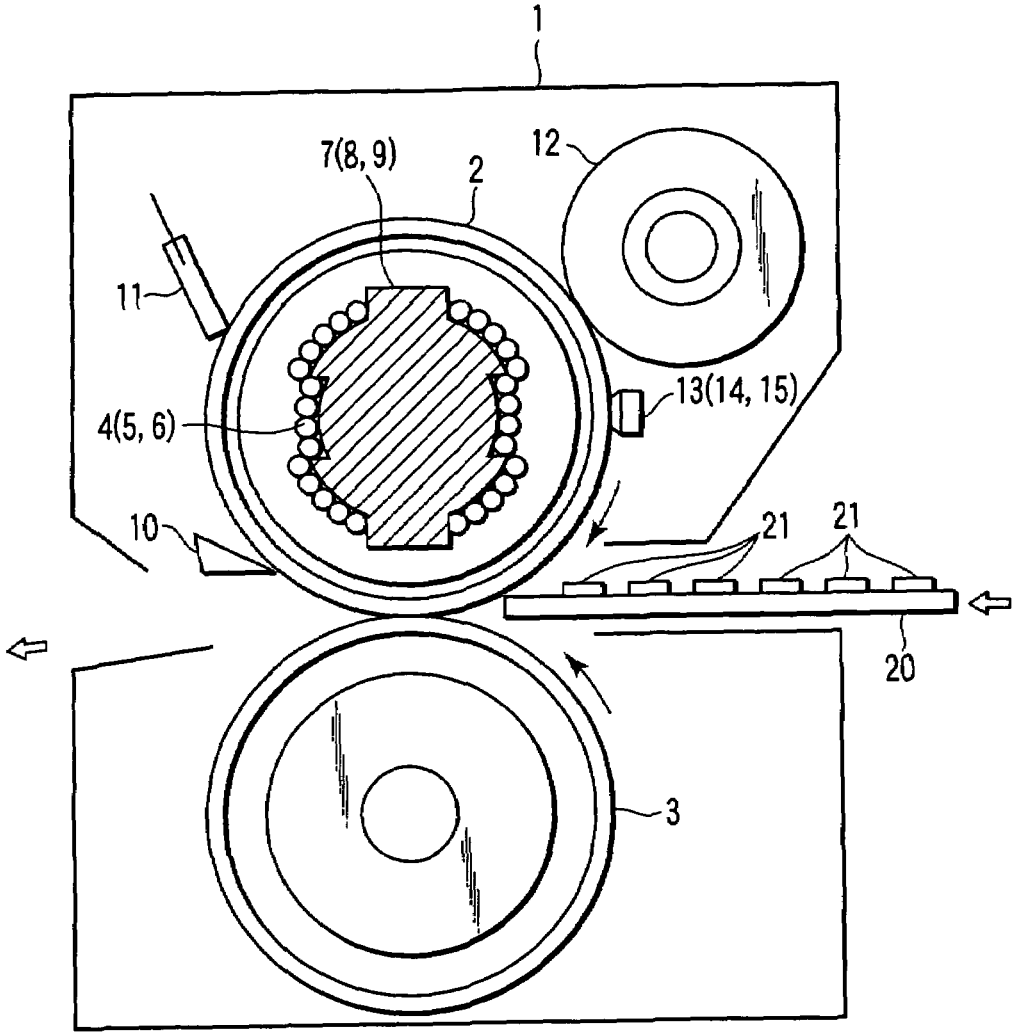
FIG. 1 is a diagram showing the configuration of fixing apparatus that is an embodiment.
Figure 2:
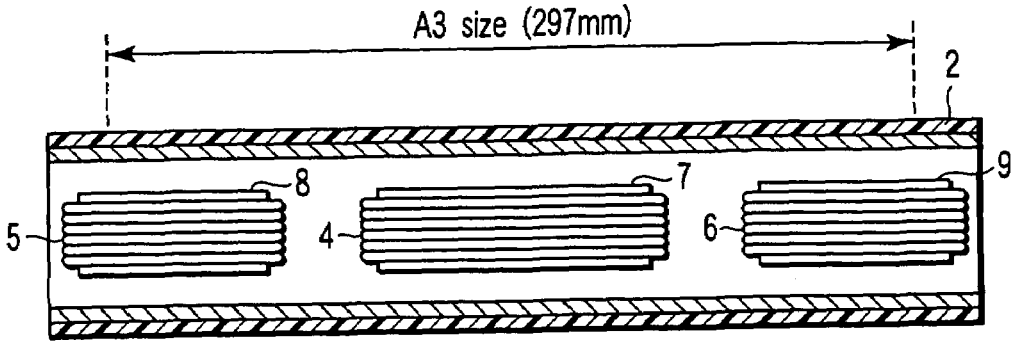
FIG. 2 is a diagram depicting the configuration of the heat roller, coils and cores provided in the embodiment.

FIGS. 1 and 2 show the structure of the fixing apparatus.

The fixing apparatus 1 has a rotary heat member, e.g., a heat roller 2. The heat roller 2 is provided on a press roller 8, i.e., a pressing member, with a paper-transporting path extending between the heat roller 2 and the press roller 8. The heat roller 2 is located above the paper-transporting path, and the press roller 8 below the path. Through the paper-transporting path a paper sheet 20 is transported, to which an image will be fixed. The press roller 8 contacts the surface (outer circumferential surface) of the heat roller 2, pressed to the heat roller. It rotates together with the heat roller 2, nipping the paper sheet 20 between it and the heat roller 2, exerting a pressure to the paper sheet 20. While nipped, the paper sheet 20 receives heat from the heat roller 2. The heat melts the developer on the paper sheet 20, fixing the developer image 21 to the paper sheet 20.

The heat roller 2 comprises a metal member and a surface member (a molded layer made of PTFE, PFA or the like) covering the metal member. It is rotated clockwise. The press roller 8 comprises a metal core and a silicon rubber layer or fluororubber layer covering the metal core. It rotates counterclockwise.

The heat roller 2 contains a center coil (first coil) 4 and side coils (second coils) 5 and 6. The center coil 4 is provided in that part of the heat roller 2, which is almost middle in the direction (axial direction) that intersects at right angles with the direction in which the heat roller 2 rotates. The side coil 5 is provided in that part of the heat roller 2, which is one end in the direction that intersects at right angles with the direction in which the heat roller 2 rotates. The side coil 6 is provided in that part of the heat roller 2, which is the other end in the direction that intersects at right angles with the direction in which the heat roller 2 rotates. The side coils 5 and 6 are connected to each other, forming one coil in effect.

These coils 4, 5 and 6 are secured to cores 7, 8 and 9, respectively. They generate high-frequency magnetic fields to accomplish induction heating. When the high-frequency magnetic fields are applied to the heat roller 2, eddy currents flow in the metal member of the heat roller 2. From the eddy currents the metal member generates Joule heat. Thus, the center coil 4 performs induction heating at the middle part of the heat roller 2, and the side coils 5 and 6 carry out induction heating at the end parts of the heat roller 2.

A claw 10, a cleaning member 11, an oil-applying roller 12, temperature sensors 13 and 14, and a thermostat 15 are arranged around the heat roller 2. The claw 10 is provided to peel a paper sheet 20 from the heat roller 2. The cleaning member 11 is used to remove paper residual developer, paper dust and the like from the heat roller 2. The oil-applying roller 12 applies oil to the surface of the heat roller 2. The temperature sensors 13 and 14 detect the temperatures at the surface of the heat roller 2. The thermostat 15 operates upon detecting the temperature at the surface of the heat roller 2.

The temperature sensor 13 detects the temperature T1 of that part of the heat roller 2, which is almost middle in the direction (axial direction) that intersects at right angles with the direction in which the heat roller 2 rotates. The temperature sensor 14 detects the temperature T1 of that part of the heat roller 2, which is the other end in the direction (axial direction) that intersects at right angles with the direction in which the heat roller 2 rotates. The thermostat 15 detects the temperature of one-end edge of the heat roller 2 and opens when the temperature detected reaches increases to an unusually high point.

The temperature sensors 13 and 14 and the thermostat 15 may either contact-type ones that contact the surface of the heat roller 2 or non-contact type ones that are spaced from the heat roller 2.

Figure 3:
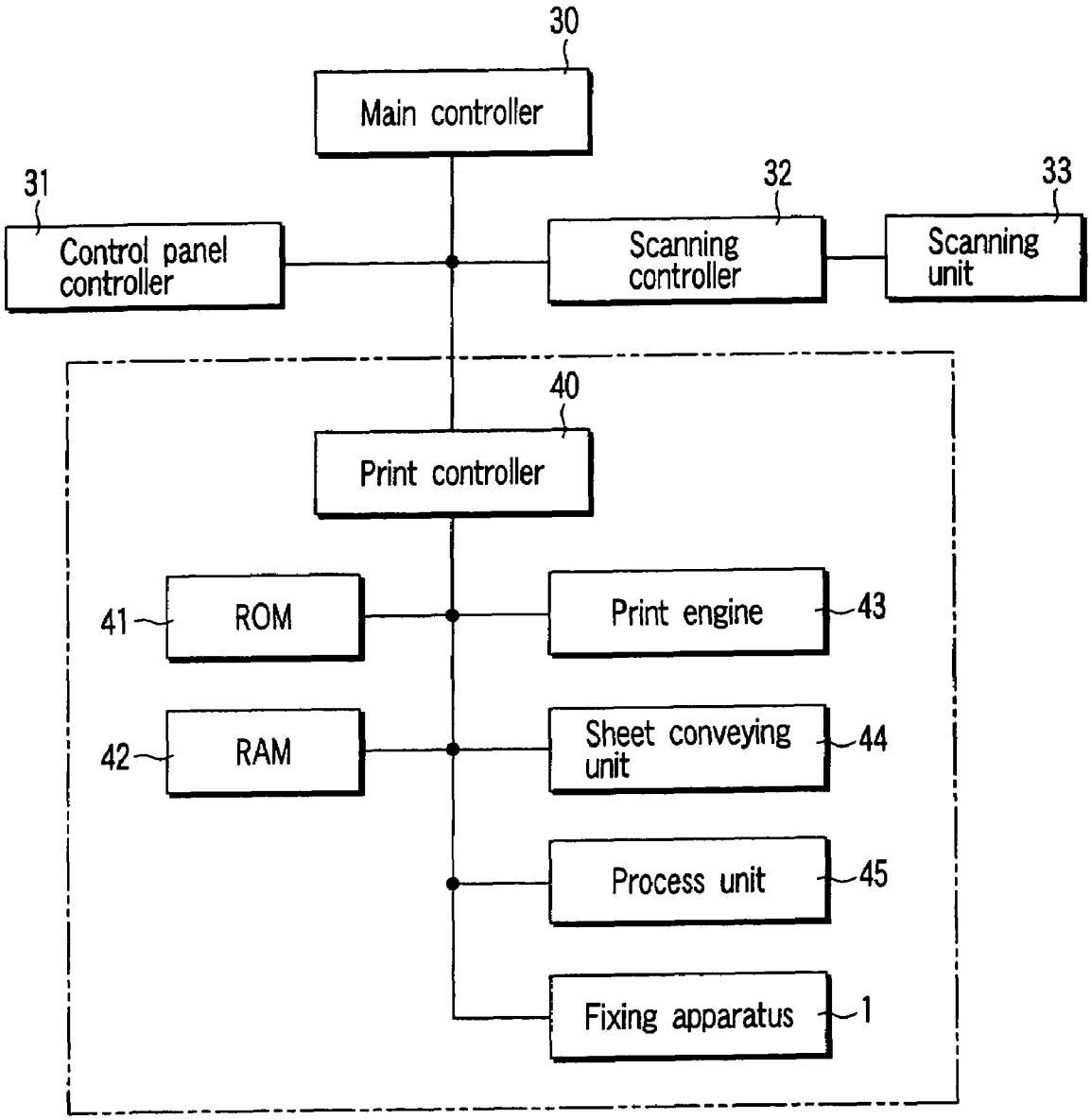
FIG. 3 is a block diagram of the control circuit incorporated in an image forming apparatus that is an embodiment.

FIG. 3 depicts the control circuit incorporated in the image forming apparatus described above.

In the circuit, a control panel controller 31, a scanning controller 32, and a print controller 40 are connected to a main controller 30.

The main controller 30 controls the control panel controller 31, scanning controller 32 and print controller 40. The scanning controller 32 controls the scanning unit 33 that optically reads images from documents.

To the print controller 40 there are connected to a ROM 41, a RAM 42, a print engine 43, a sheet conveying unit 44, the process unit 45 and the fixing apparatus 1. The ROM 41 stores control programs. The RAM is provided to store data. The print engine 43 emits a laser beam, which is applied to the photosensitive drum of the process unit 45 to form an image read by the scanning unit 33, on the photosensitive drum. The sheet conveying unit 44 comprises a mechanism for transporting paper sheets 20 and a drive circuit for driving the mechanism. The process unit 45 uses the laser beam emitted from the print engine 43, forming an electrostatic image on the surface of the photosensitive drum, develops the electrostatic image on the photosensitive drum, using the developer, and transfers the image developed to a paper sheet 20.

Figure 4:
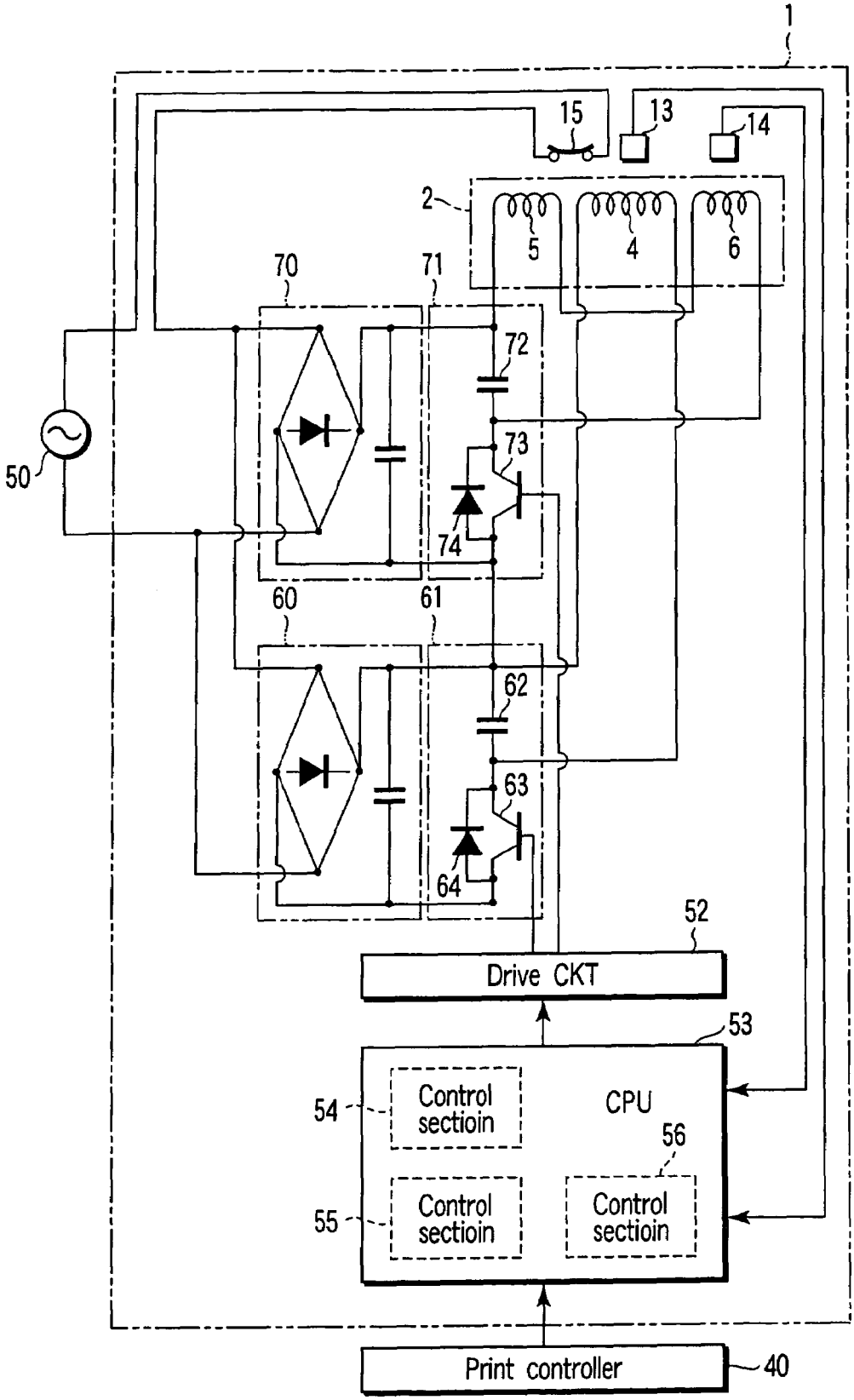
FIG. 4 is a block diagram of the electric circuit provided in a fixing apparatus that is an embodiment.

FIG. 4 illustrates the electric circuit incorporated in the fixing apparatus 1.

In the electric circuit, the thermostat 15 connects rectifying circuits 60 and 70 to a commercially available power supply 50. High-frequency wave generating circuits (also called "switching circuits") 61 and 71 are connected to the outputs of the rectifying circuits 60 and 70, respectively.

The high-frequency wave generating circuits 61 comprises a resonance capacitor 62, a switching element, such as a transistor 63, and a damper diode 64. The resonance capacitor 62 constitutes a resonant circuit, jointly with the center coil 4. The transistor 63 excites the resonant circuit. The damper diode 64 is connected in parallel to the transistor 63. When the transistor 63 is repeatedly turned on and off by a drive circuit 52, it generates a high-frequency current.

The high-frequency wave generating circuit 71 comprises a resonance capacitor 72, a switching element, such as a transistor 73, and a damper diode 74. The resonance capacitor 72 constitutes a resonant circuit, jointly with the side coils 5 and 6. The transistor 73 excites the resonant circuit. The damper diode 74 is connected in parallel to the transistor 63. When the transistor 73 is repeatedly turned on and off by a drive circuit 52, it generates a high-frequency current.

The high-frequency wave generating circuits 61 and 71 generate high-frequency currents, which are supplied to the center coil 4 and the side coils 5 and 6. The center coil 4 and the side coils 5 and 6 therefore generate high-frequency magnetic fields. The high-frequency magnetic fields change into eddy currents in the metal member of the heat roller 2. Joule heat is generated from the eddy currents. The metal member is thereby heated.

The temperature sensors 13 and 14, the print controller 40, and the drive circuit 52 are connected to a CPU 53. The CPU 53 has a first control section 54, a second control section 55, and a third control section 56.

The first control section 54 alternately drives the center coil 4, on the one hand, and the side coils 5 and 6, on the other.

The second control section 55 controls the ratio of the operating time A of the center coil 4 to the operating time of the side coils 5 and 6, in accordance with the ratio of the temperature T1 detected by the temperature sensor 13 to the temperature T2 detected by the temperature sensor 14. More specifically, the second control section 55 compares the temperature T1 detected by the temperature sensor 13 with a value (T2−X) obtained by subtracting a correction value X from the temperature T2 detected by the temperature sensor 14. If T1≧(T2−X), the section 55 makes the operating time B of the side coils 5 and 6 longer than the operating time A of the center coil 4. If T1<(T2−X), the section 55 makes the operating time A of the center coil 4 longer than the operating time B of the side coils 5 and 6. The correction value X is changed on the basis of the temperature T1 detected by the temperature sensor 13.

The third control section 56 controls the output of the center coil 4 and the outputs of the side coils 5 and 6, in accordance with the size and thickness of the paper sheet 20.

Figure 5:
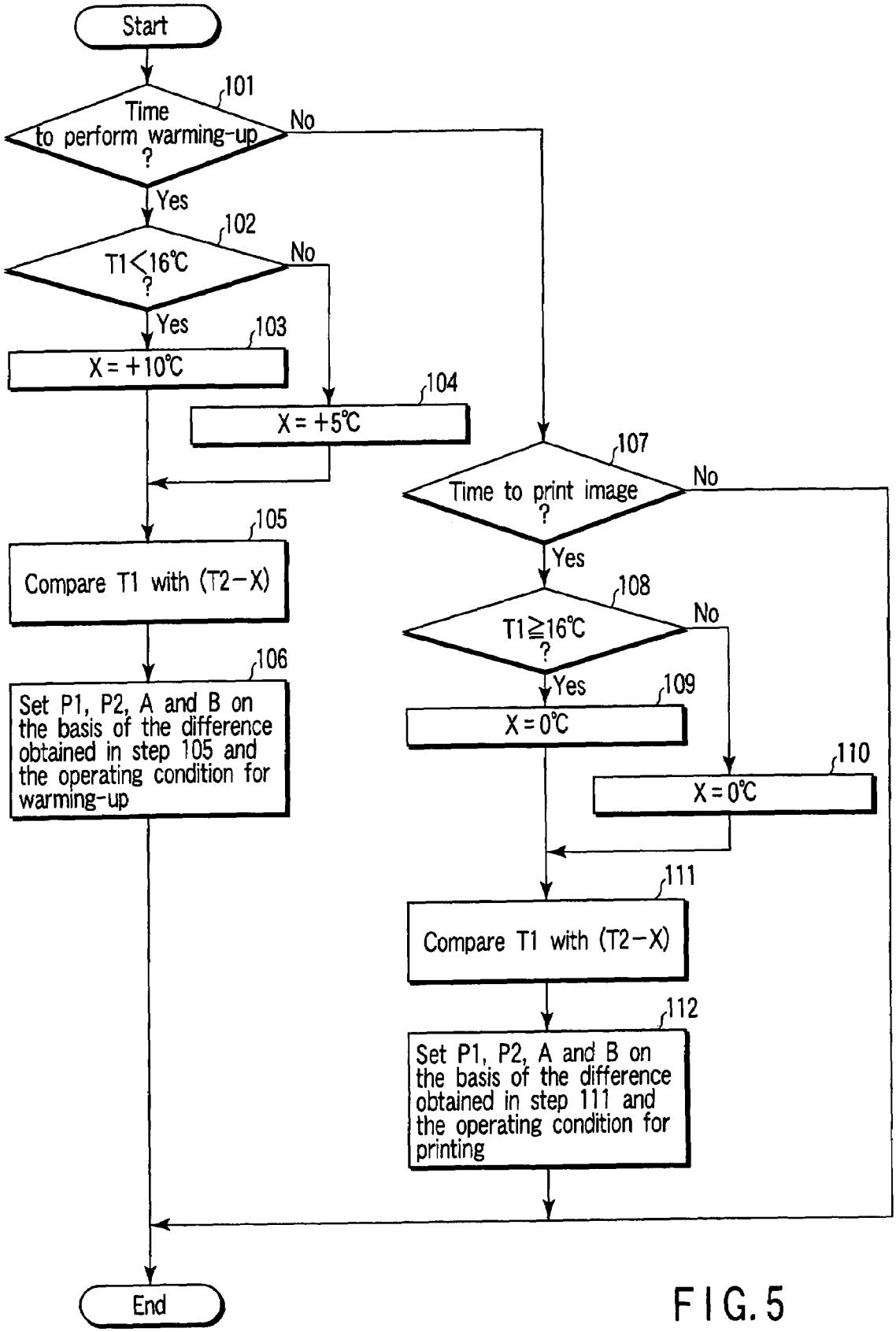
FIG. 5 is a flowchart explaining the operation of an embodiment.

How the fixing apparatus 1 operates will be explained, with reference to the flowchart of FIG. 5.

When the commercially available power supply 50 is turned on, the center coil 4, on the one hand, the side coils 5 and 6, on the other, are alternately driven. Warming-up is thereby carried out, raising the temperature of the heat roller 2.

If the warming-up is performed (YES in Step 101), a command value for setting the correction value X is selected in accordance with the temperature T1 detected by the temperature sensor 13 and the correction-value setting conditions shown in FIG. 6. For example, a command value "1" is selected if the temperature T1 is lower than 16° C. in the initial phase of the warming-up (YES in Step 102). In accordance with the command value "1" and the associated condition shown in FIG. 7, a correction value, X=+10° C. is set (Step 103). When the temperature T1 rises to 16° C. or more (NO in Step 102), a command value "2" is selected. In accordance with the command value "2" and the associated condition shown in FIG. 7, a correction value, X=+5° C. is set (Step 104).

The correction value X is subtracted from the temperature T2 detected by the temperature sensor 14. The difference (T2−X) obtained in this subtraction is compared with the temperature T1 detected (Step 105). On the basis of the results of this comparison and the operating condition for warming-up, shown in FIG. 8, the output P1 of the center coil 4, the output P2 of the side coils 5 and 6, the operating time A of the center coil 4, and the operating time B of the side coils 5 and 6 are set (Step 106).

More precisely, the output P1 of the center coil 4 and the output P2 of the side coils 5 and 6 are set to 900 W. If T1≧(T2−X), the operating time A of the center coil 4 is set to 0.1 sec and the operating time B of the side coils 5 and 6 is set to 0.2 sec. If T1<(T2−X), the operating time A of the center coil 4 is set to 0.2 sec and the operating time B of the side coils 5 and 6 is set to 0.1 sec.

When the temperatures T1 and T2 detected by the temperature sensors 13 and 14, respectively, reach to a preset temperature Ts, the alternate driving of the center coil 4 and side coils 5 and 6 is stopped. The warming-up is thereby terminated, and the fixing apparatus is set in ready mode.

In print mode (NO in Step 101 and YES in Step 107), a command value for setting the correction value X is selected in accordance with the temperature T1 detected by the temperature sensor 13 and the correction-value setting conditions shown in FIG. 6. For example, a command value "3" is selected if the temperature T1 is lower than 16° C. (YES in Step 108). In accordance with this command value "3" and the associated condition shown in FIG. 7, a correction value, X=+0° C. is set (Step 109). Even when the temperature T1 rises to 16° C. or more (NO in Step 108), the command value "3" is selected. In accordance with the command value "3" and the associated condition shown in FIG. 7, a correction value, X=0° C. is set (Step 110).

The correction value X is subtracted from the temperature T2 detected by the temperature sensor 14. From the difference (T2−X) obtained in this subtraction is compared with the temperature T1 (Step 111). On the basis of the result of the comparison and the operation condition shown in FIG. 9, the output P1 of the center coil 4, the output P2 of the side coils 5 and 6, the operating time A of the center coil 4, and the operating time B of the side coils 5 and 6 are set as follows (Step 112).

(1) If the paper sheet 20 has A4 size or A3 size and regular thickness (64 to 80 g/m$^2$), the outputs P1 and P2 are set to 900 W, that is, P1=900 W, P2=900 W. If T1≧(T2−X), the operating time A is set to 0.1 sec, and the operating time B to 0.2 sec. If T1<(T2−X), the operating time A is set to 0.2 sec, and the operating time B to 0.1 sec.

(2) If the paper sheet 20 has A4 size or A3 size and are thick (81 to 209 g/m$^2$), the outputs P1 and P2 are set to 900 W, that is, P1=900 W, P2=900 W. If T1≧(T2−X), the operating time A is set to 0.1 sec, and the operating time B to 0.2 sec. If T1<(T2−X), the operating time A is set to 0.2 sec, and the operating time B to 0.1 sec.

(3) If the paper sheet 20 has B4 size or B5 size and regular thickness (64 to 80 g/m$^2$), the outputs P1 and P2 are set to 900 W and 800 W, respectively, that is, P1=900 W, P2=800 W. If T1≧(T2−X), the operating time A is set to 0.1 sec, and the operating time B to 0.2 sec. If T1<(T2−X), the operating time A is set to 0.35 sec, and the operating time B to 0.2 sec.

(4) If the paper sheet 20 has B4 size or B5 size and are thick (81 to 209 g/m$^2$), the outputs P1 and P2 are set to 1000 W and 800 W, respectively, that is, P1=1000 W, P2=800 W. If T1≧(T2−X), the operating time A is set to 0.1 sec, and the operating time B to 0.2 sec. If T1<(T2−X), the operating time A is set to 0.3 sec, and the operating time B to 0.2 sec.

(5) If the paper sheet 20 has A4-R size and regular thickness (64 to 80 g/m$^2$), the outputs P1 and P2 are set to 900 W and 800 W, respectively, that is, P1=900 W, P2=800 W. If T1≧(T2−X), the operating time A is set to 0.1 sec, and the operating time B to 0.2 sec. If T1<(T2−X), the operating time A is set to 0.35 sec, and the operating time B to 0.2 sec.

(6) If the paper sheet 20 has A4-R size and are thick (81 to 209 g/m$^2$), the outputs P1 and P2 are set to 1000 W and 800 W, respectively, that is, P1=1000 W, P2=800 W. If T1≧(T2−X), the operating time A is set to 0.1 sec, and the operating time B to 0.2 sec. If T1<(T2−X), the operating time A is set to 0.3 sec, and the operating time B to 0.2 sec.

(7) If the paper sheet 20 has B5-R size and regular thickness (64 to 80 g/m$^2$), the outputs P1 and P2 are set to 900 W and 700 W, respectively, that is, P1=900 W, P2=700 W. If T1≧(T2−X), the operating time A is set to 0.1 sec, and the operating time B to 0.2 sec. If T1<(T2−X), the operating time A is set to 0.45 sec, and the operating time B to 0.3 sec.

(8) If the paper sheet 20 has B5-R size and are thick (81 to 209 g/m$^2$), the outputs P1 and P2 are set to 1000 W and 700 W, respectively, that is, P1=1000 W, P2=700 W. If T1≧(T2−X), the operating time A is set to 0.1 sec, and the operating time B to 0.2 sec. If T1<(T2−X), the operating time A is set to 0.4 sec, and the operating time B to 0.3 sec.

(9) If the paper sheet 20 has A5-R size and regular thickness (64 to 80 g/m$^2$), the outputs P1 and P2 are set to 900 W and 700 W, respectively, that is, P1=900 W, P2=700 W. If T1≧(T2−X), the operating time A is set to 0.1 sec, and the operating time B to 0.2 sec. If T1<(T2−X), the operating time A is set to 0.45 sec, and the operating time B to 0.3 sec.

(10) If the paper sheet 20 has A5-R size and are thick (81 to 209 g/m$^2$), the outputs P1 and P2 are set to 1000 W and 700 W, respectively, that is, P1=1000 W, P2=700 W. If T1≧(T2−X), the operating time A is set to 0.1 sec, and the operating time B to 0.2 sec. If T1<(T2−X), the operating time A is set to 0.4 sec, and the operating time B to 0.3 sec.

(11) If the paper sheet 20 is a postcard, the outputs P1 and P2 are set to 900 W and 700 W, respectively, that is, P1=900 W, P2=700 W. If T1≧(T2−X), the operating time A is set to 0.1 sec, and the operating time B to 0.2 sec. If T1<(T2−X), the operating time A is set to 0.45 sec, and the operating time B to 0.3 sec.

Figure 10:
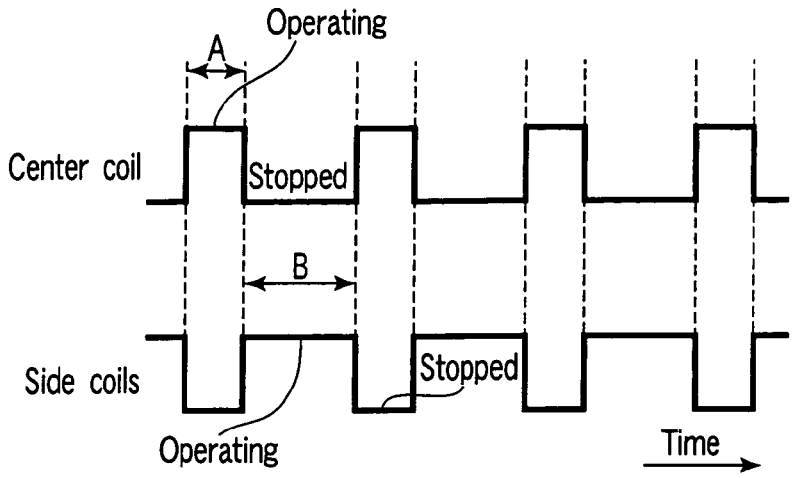
FIG. 10 is a diagram illustrating the relation between the operating time of the center coil and the operating time of the side coils in an embodiment.

FIG. 10 illustrates the relation between the operating time A of the center coil 4 and the operating time B of the side coils 5 and 6.

The operating time B of the side coils 5 and 6 is set longer than the operating time A of the center coil 4 when the temperature T1 of the middle part of the heat roller 2 is higher than the temperature T2 of the end parts of the heat roller 2 [T1≧(T2−X)]. In this case, the temperature T2 of the end parts of the heat roller 2 rises to the temperature T1 of the middle part of the heat roller 2.

Conversely, the operating time A of the center coil 4 is set longer than the operating time B of the side coils 5 and 6 when the temperature T1 of the middle part of the heat roller 2 is lower than the temperature T2 of the end parts of the heat roller 2 [T1<(T2−X)]. In this case, the temperature T1 of the middle part of the heat roller 2 falls to the temperature T2 of the end parts of the heat roller 2.

Figure 11:
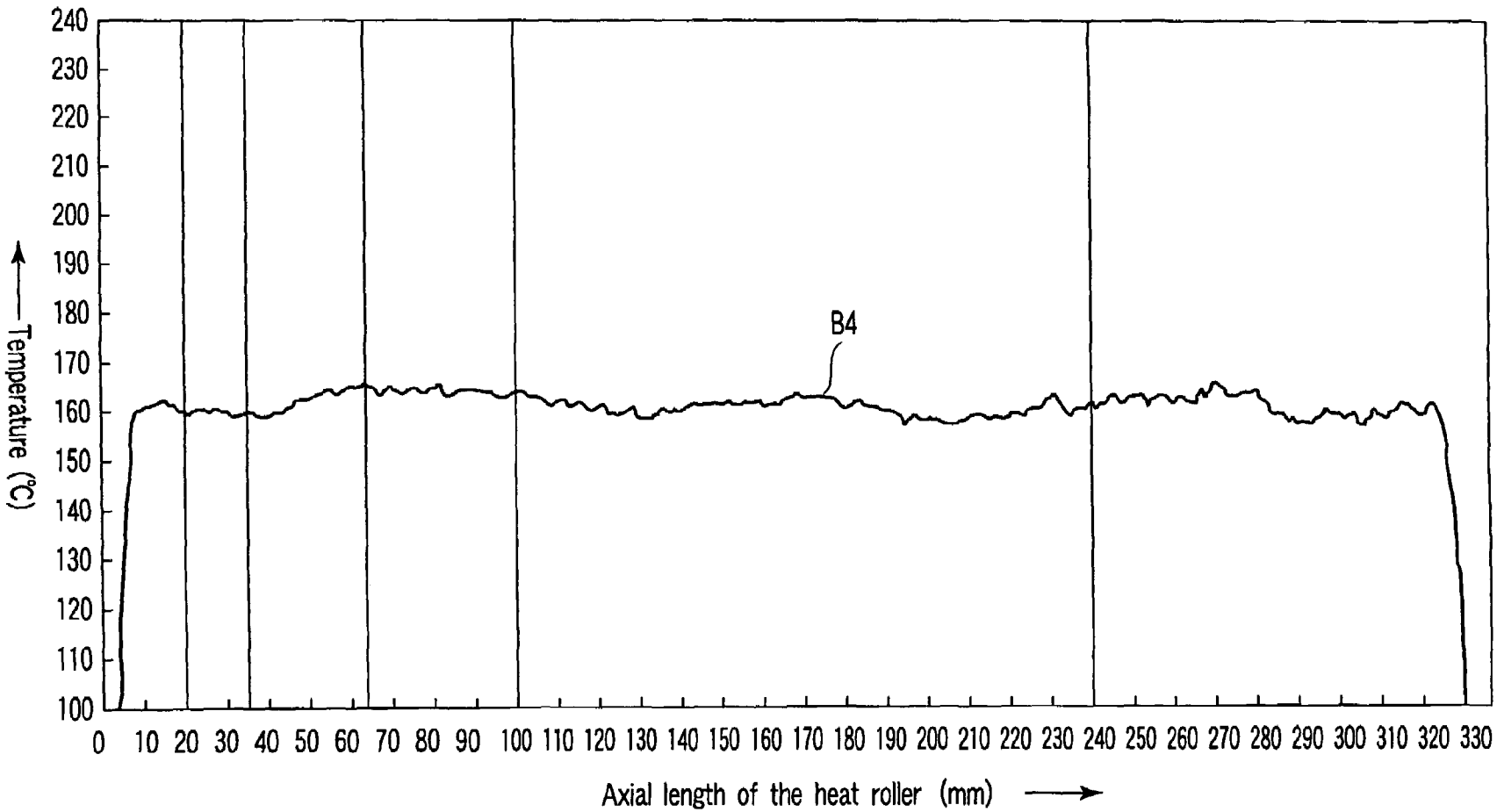
FIG. 11 is a graph showing how the temperature is distributed in the heat roller in the axial direction thereof, in an embodiment.

Thus, as FIG. 11 shows, the middle part and end parts of the heat roller 2 can be maintained at the same temperature. Since the operating time A of the center coil 4 and the operating time B of the side coils 5 and 6 are shorter than 0.5 sec, or as short as 0.1 sec to 0.2 sec. A high-precision temperature control is therefore achieved. By virtue of the high-precision temperature control, the temperature irregularity that the heat roller 2 has in its axial direction can be reduced to ±5° C. FIG. 11 shows how the temperature distribution that is observed when a paper sheet 20 of B4 is used. When paper sheets of other sizes are used, similar results are obtained.

Figure 12:
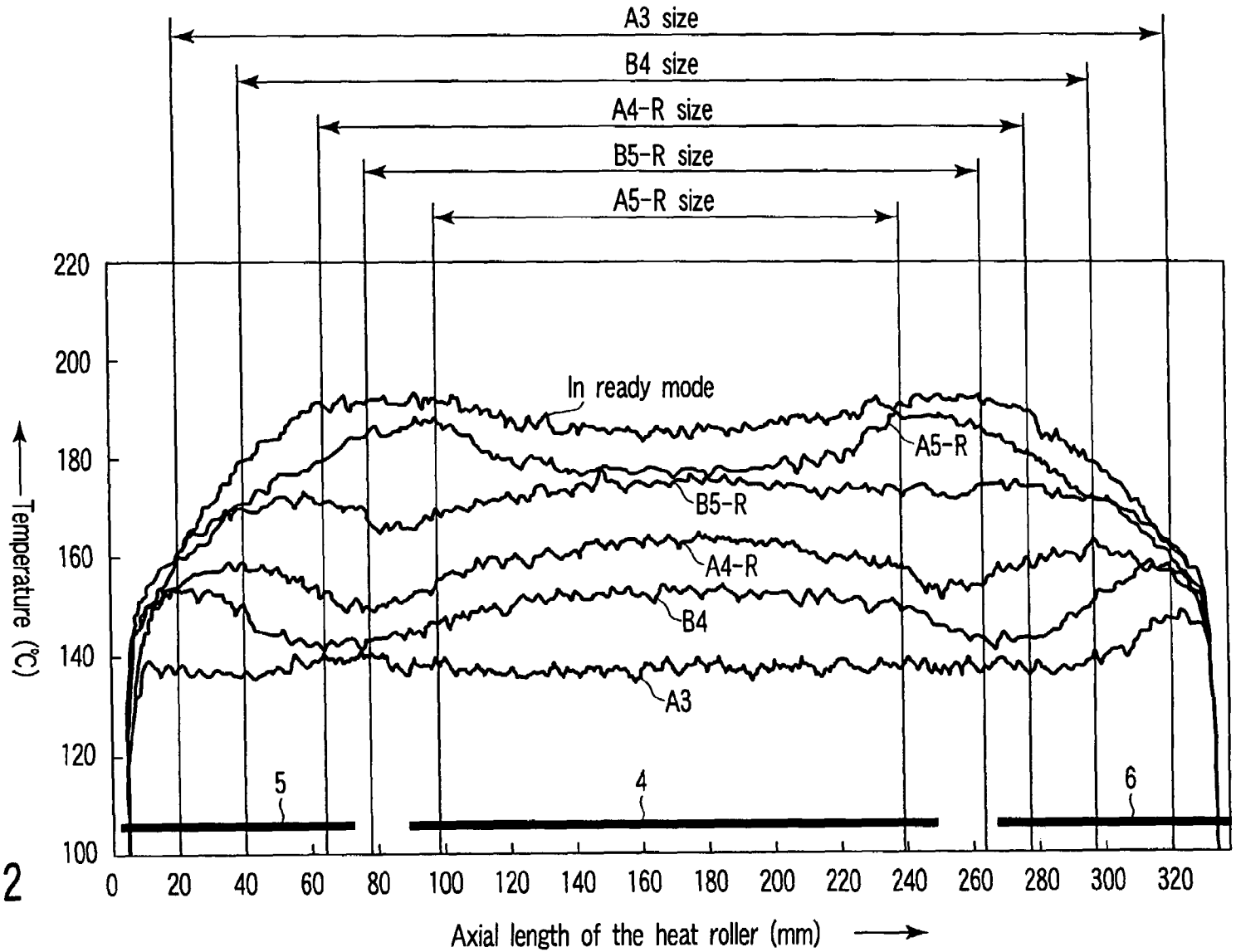
FIG. 12 is a graph illustrating how the temperature is usually distributed in a heat roller in the axial direction thereof.

If no control is performed in the present embodiment, the temperature distribution in the heat roller 2 in the axial direction will greatly change as is illustrated in FIG. 12. That is, the temperature irregularity that the heat roller 2 has in its axial direction will increase to about ±7.5° C., depending on the size of the paper sheet 20. This undesirable event would not take place in the present embodiment.

The middle part and end parts of the heat roller 2 can therefore be maintained at the same temperature. The undesirable event that the temperature of the end parts of the heat roller 2 rises to a higher temperature than the temperature of the middle part will be take place.

Since the temperature of the end parts of the heat roller 2 does not rise to a higher temperature than the temperature of the middle part, the hardness of press roller 3 does not decrease faster at the end parts than at the middle part. Therefore, the paper-transporting efficiency that the press roller has at its end parts does not fall below the efficiency at its middle part. As a result, the paper sheet 20 would not be creased.

Since the temperature of the end parts of the heat roller 2 does not rise to a higher temperature than the temperature of the middle part, much water does not evaporate from the lateral edges of the paper sheet 20. Hence, the paper sheet 20 is not curled.

Moreover, the output P1 of the center coil 4 and the output P2 of the side coils 5 and 6 are changed in accordance with the size and thickness of the paper sheet 20. This reliably renders uniform the temperatures of the middle part and end parts of the heat roller 2, whichever size and whichever thickness the paper sheet 20 has.

Figure 13:
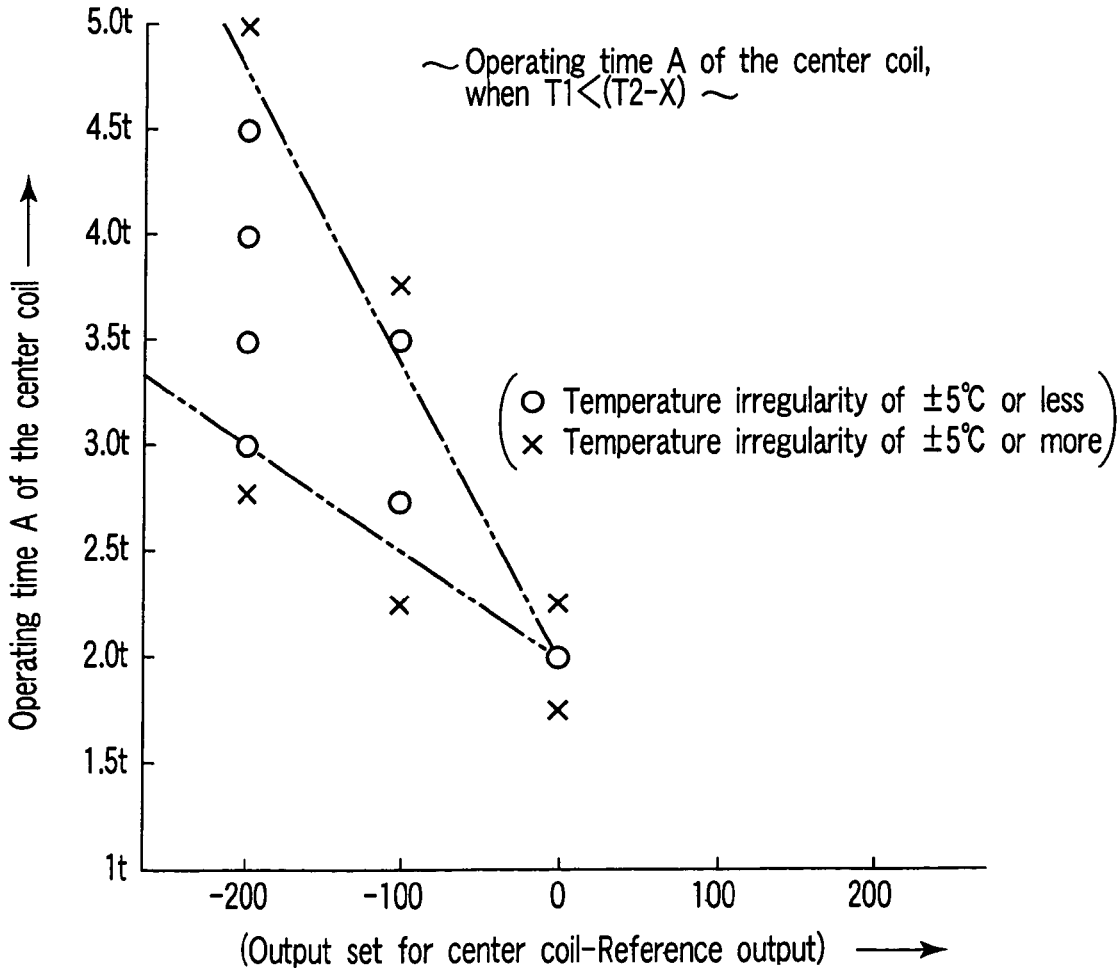
FIG. 13 is a graph showing the temperature irregularity in a heat roller in an embodiment, which is observed when the output of the center coil and the operating time are used as parameters.

FIG. 13 shows how the temperature irregularity the heat roller 2 has in its axial direction changes with the difference between the output set for the center coil 4 and a reference output and the operating time A of the center coil 4. The reference output is one set for A4-size paper sheets and is, for example, 900 W. In FIG. 12, "t" is the reference operating time, i.e., the basis of the operating time A, and is 0.1 sec.

The temperature irregularity that the heat roller 2 has in its axial direction falls within ±5% in the region indicated by a two-dot, dashed line in FIG. 13. This region is defined by the following formula (1) or (2):

$$\text{Reference operating time } t-(\text{set output}-\text{reference output})/500 \text{ to } 1500 \quad (1)$$

$$\text{Operating time } A-(\text{set output}-\text{reference output})/1000 \text{ to } 3000 \quad (2)$$

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a heating member which rotates;

a pressing member which rotate together with the heating member, while remaining in contact with the heating member, and which exerts a pressure to an object nipped between the heating member and the pressing member;

a first coil which performs induction heating at a first region that is a part of the heating member and extends in a direction that intersects at right angles with a direction in which the heating member rotates;

a second coil which performs induction heating at a second region that is a different part of the heating member and extends in the direction that intersects at right angles with the direction in which the heating member rotates;

a first temperature sensor which detects a temperature T1 of the first region of the heating member, which extends in the direction that intersects at right angles with the direction in which the heating member rotates;

a second temperature sensor which detects a temperature T2 of the second region of the heating member, which extends in the direction that intersects at right angles with the direction in which the heating member rotates;

first control means which causes the first coil and the second coil to operate alternately; and second control means which controls a ratio of an operating time of the first coil to an operating time of the second coil, in accordance with a ratio of the temperature T1 detected by the first temperature sensor to the temperature T2 detected by the second temperature sensor.

2. The apparatus according to claim 1, wherein the second control means compares the temperature T1 detected by the first temperature sensor with a value (T2−X) obtained by subtracting a correction value X from the temperature T2 detected by the second temperature sensor, sets the operating time of the second coil longer than the operating time of the first coil when T1≧(T2−X), and sets the operating time of the first coil longer than the operating time of the second coil when T1<(T2−X).

3. The apparatus according to claim 2, wherein the correction value X is changed in accordance with the temperature T1 detected by the first temperature sensor.

4. The apparatus according to claim 1, further comprising third control means which controls an output of the first coil and an output of the second coil in accordance with a size of the object.

5. The apparatus according to claim 1, further comprising third control means which controls an output of the first coil and an output of the second coil in accordance with a size and thickness of the object.

6. The apparatus according to claim 1, further comprising:

a first high-frequency wave generating circuit which outputs a high-frequency current for causing the first coil to generate a high-frequency magnetic field for performing induction heating; and a second high-frequency wave generating circuit which outputs a high-frequency current for causing the second coil to generate a high-frequency magnetic field for performing induction heating.

7. A fixing apparatus comprising:

a heat roller which rotates;

a press roller which rotates together with the heat roller, while remaining in contact with the heat roller, and which exerts a pressure to a paper sheet nipped between the heat roller and the press roller;

a first coil which performs induction heating at that part of the heat roller, which is almost middle in an axial direction of the heat roller;

a second coil which performs induction heating at one end part and other end part of the heat roller, which extend in an axial direction of the heat roller;

a first temperature sensor which detects a temperature T1 of a part of the heating member, which is almost middle in a direction that intersects at right angles with the axial direction of the heat roller;

a second temperature sensor which detects a temperature T2 of one end part or other end part of the heating member, which extends in the direction that intersects at right angles with the axial direction of the heat roller;

a first control section which alternately drives the first coil and the second coil; and a second control section which controls a ratio of an operating time of the first coil to an operating time of the second coil, in accordance with a ratio of the temperature T1 detected by the first temperature sensor to the temperature T2 detected by the second temperature sensor.

8. The apparatus according to claim 7, wherein the second control section compares the temperature T1 detected by the first temperature sensor with a value (T2−X) obtained by subtracting a correction value X from the temperature T2 detected by the second temperature sensor, sets the operating time of the second coil longer than the operating time of the first coil when T1≧(T2−X), and sets the operating time of the first coil longer than the operating time of the second coil when T1<(T2−X).

9. The apparatus according to claim 8, wherein the correction value X is changed in accordance with the temperature T1 detected by the first temperature sensor.

10. The apparatus according to claim 7, further comprising third control means which controls an output of the first coil and an output of the second coil in accordance with a size of the object.

11. The apparatus according to claim 7, further comprising third control means which controls an output of the first coil and an output of the second coil in accordance with a size and thickness of the object.

12. The apparatus according to claim 7, further comprising:

a first high-frequency wave generating circuit which outputs a high-frequency current for causing the first coil to generate a high-frequency magnetic field for performing induction heating; and a second high-frequency wave generating circuit which outputs a high-frequency current for causing the second coil to generate a high-frequency magnetic field for performing induction heating.

13. An image forming apparatus comprising:

a process unit which forms an image on a paper sheet; and a fixing apparatus which fixes the image formed on the paper sheet, by heating the paper sheet, wherein the fixing apparatus comprises:

a heating member which rotates;

a pressing member which rotate together with the heating member, while remaining in contact with the heating member, and which exerts a pressure to an object nipped between the heating member and the pressing member;

a first coil which performs induction heating at a part of the heating member, which is almost middle in a direction that intersects at right angles with a direction in which the heating member rotates;

a second coil which performs induction heating at one end part and other end part of the heating member, which extend in the direction that intersects at right angles with the direction in which the heating member rotates;

a first temperature sensor which detects a temperature T1 of the part of the heating member, which is almost middle in the direction that intersects at right angles with the direction in which the heating member rotates;

a second temperature sensor which detects a temperature T2 of one end part and other end part of the heating member, which extend in the direction that intersects at right angles with the direction in which the heating member rotates;

first control means which causes the first coil and the second coil to operate alternately; and second control means which controls a ratio of an operating time of the first coil to an operating time of the second coil, in accordance with a ratio of the temperature T1 detected by the first temperature sensor to the temperature T2 detected by the second temperature sensor.

14. The apparatus according to claim 13, wherein the second control means compares the temperature T1 detected by the first temperature sensor with a value (T2−X) obtained by subtracting a correction value X from the temperature T2 detected by the second temperature sensor, sets the operating time of the second coil longer than the operating time of the first coil when $T1 \geqq (T2-X)$, and sets the operating time of the first coil longer than the operating time of the second coil when $T1 < (T2-X)$.

15. The apparatus according to claim 14, wherein the correction value X is changed in accordance with the temperature T1 detected by the first temperature sensor.

16. The apparatus according to claim 13, further comprising third control means which controls an output of the first coil and an output of the second coil in accordance with a size of the object.

17. The apparatus according to claim 13, further comprising third control means which controls an output of the first coil and an output of the second coil in accordance with a size and thickness of the object.

18. The apparatus according to claim 13, further comprising:

a first high-frequency wave generating circuit which outputs a high-frequency current for causing the first coil to generate a high-frequency magnetic field for performing induction heating; and a second high-frequency wave generating circuit which outputs a high-frequency current for causing the second coil to generate a high-frequency magnetic field for performing induction heating.

* * * * *